US007985122B2

(12) United States Patent
Bottema

(10) Patent No.: US 7,985,122 B2
(45) Date of Patent: Jul. 26, 2011

(54) METHOD OF POLISHING A LAYER USING A POLISHING PAD

(75) Inventor: Brian Bottema, Austin, TX (US)

(73) Assignee: Freescale Semiconductor, Inc, Austin, TX (US)

( * ) Notice: Subject to any disclaimer, the term of this patent is extended or adjusted under 35 U.S.C. 154(b) by 1046 days.

(21) Appl. No.: 11/423,760

(22) Filed: Jun. 13, 2006

(65) Prior Publication Data

US 2007/0287361 A1 Dec. 13, 2007

(51) Int. Cl.
*B24B 7/22* (2006.01)

(52) U.S. Cl. ..... 451/11; 451/527

(58) Field of Classification Search ..... 451/443, 451/444, 56, 526, 527, 533, 534, 165; 51/293, 51/297, 298
See application file for complete search history.

(56) References Cited

U.S. PATENT DOCUMENTS

| | | | | |
|---|---|---|---|---|
| 5,904,615 | A * | 5/1999 | Jeong et al. | 451/443 |
| 6,083,085 | A * | 7/2000 | Lankford | 451/56 |
| 6,227,947 | B1 * | 5/2001 | Hu et al. | 451/56 |
| 6,241,588 | B1 * | 6/2001 | Brown et al. | 451/56 |
| 6,508,697 | B1 * | 1/2003 | Benner et al. | 451/443 |
| 6,875,096 | B2 | 4/2005 | Park et al. | |
| 7,029,365 | B2 * | 4/2006 | Chang et al. | 451/5 |

* cited by examiner

*Primary Examiner* — Robert Rose
(74) *Attorney, Agent, or Firm* — James L. Clingan, Jr.; David G. Dolezal

(57) ABSTRACT

A tool for forming a desired pattern on a polishing pad establishes a vibration that is coupled to the polishing pad. The vibration removes small portions of the polishing pad according to the desired pattern. The polishing pad is then used in a chemical mechanical polishing (CMP) step to polish a layer on a semiconductor device.

18 Claims, 3 Drawing Sheets

METHOD OF POLISHING A LAYER USING A POLISHING PAD

FIELD OF THE INVENTION

The invention relates to polishing layers and, more particularly, to polishing layers using a polishing pad.

BACKGROUND OF THE INVENTION

Making integrated circuits generally includes using chemical mechanical polishing (CMP) for polishing and thereby planarizing one or more of the depositied layers necessary for making the integrated circuit. Polishing pads used in CMP, typically made of polyurethane, are expended in the CMP process after some number of uses. Thus, in the course of a year, for example, a large number of polishing pads may need to be acquired. Thus, the cost of the polishing pads is relevant to the cost of making integrated circuits. Further, polishing pads are difficult to make perfectly.

One common way that polishing pads are patterned is to use a cutting approach in which a polishing pad is made to spin and a sharp object is applied to the rotating pad, analogous to a lathe operation. This often results in small strips of polyurethane, called stringers, dangling from the polishing pad. The stringers are not easily removed and, as a practical matter in a commercial environment, may not be possible to completely remove. Thus, a reduced quality of polishing pad is tolerated in the integrated circuit manufacturing process.

Another technique for patterning a polishing pad is to use a laser. One of the disadvantages of a laser is that it is difficult to form grooves with vertical walls. The walls are relatively more sloped than from the lathe approach. Another disadvantage is the high amount of local heat generated at the point where the laser hits the polishing pad.

Another technique is to use a small rotating cutting device, analogous to a router, that cuts a pattern into the polishing pad. The advantage of this approach is that the pattern does not have to be concentric circles which has been the only practical pattern for the lathe approach. The router approach, however, requires a relatively long time to form a pattern that greatly increases cost and also may leave small stringers as well. Thus, the patterns that are considered desirable than the concentric circle pattern have not been found to be practical due to high cost.

Thus, there is a need for a technique to make polishing pads and the subsequent polishing using the polishing pads that overcomes or improves upon the existing techniques described above.

BRIEF DESCRIPTION OF THE DRAWINGS

The foregoing and further and more specific objects and advantages of the invention will become readily apparent to those skilled in the art from the following detailed description of a preferred embodiment thereof taken in conjunction with the following drawings.

DETAILED DESCRIPTION OF THE INVENTION

In one aspect a tool for forming a pattern on a polishing pad establishes a vibration that is coupled to the polishing pad. The vibration removes small portions of the polishing pad according to the desired pattern. The polishing pad is then used in a chemical mechanical polishing (CMP) step to polish a layer on a semiconductor device. This is better understood by reference to the drawings and the following description.

Figure 1:
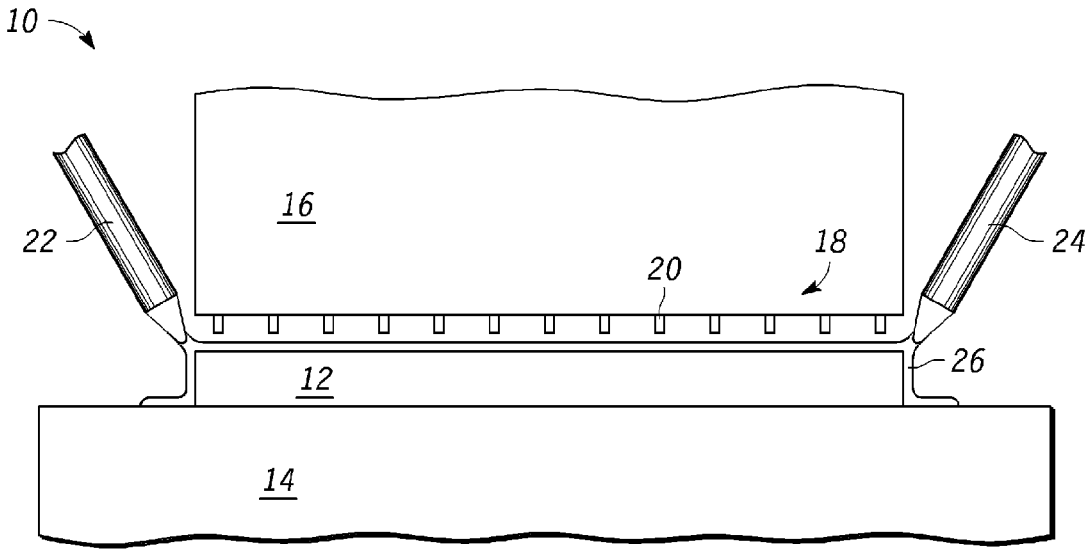
FIG. 1 is a pictorial of a polishing pad and a polishing pad apparatus useful in patterning the polishing pad according to an embodiment of the invention at a stage in processing.

Shown in FIG. 1 is patterning apparatus 10 and a polishing pad 12. Apparatus 10 comprises a supporting table 14, a vibration generator 16 having pattern features 20 according to a pattern 18, a nozzle 22, and a nozzle 24. Nozzles 22 and 24 provide a liquid 26 to polishing pad 12. Polishing pads, such as polishing pad 12, typically have a thickness of about 1 centimeter and are preferably of polyurethane.

Vibration generator 16 establishes a vibration that is coupled to polishing pad according to pattern 18. In this example, the coupling is achieved through liquid 26. Liquid 26 has small particles that are moved linearly, up and down in FIG. 1, by the vibration of vibration generator 16. The vibration from vibration generator is established using piezo electric devices that are pulsed at a relatively high frequency, at least 10,000 hertz (10 KHz), and preferably about 20 KHz. The particles are caused to hit a major surface, which is the surface facing vibration generator 16, of polishing pad 12 by the vibration of vibration generator 16. The contact of a single particle only removes a very small portion of polishing pad 12, but at the rate of thousands of times per second the removal rate is quite high. The result is that the full depth of removal is achieved relatively quickly. Also, in this example, vibration generator has the whole pattern so that pattern 18 is applied to polishing pad 12 simultaneously.

Figure 2:
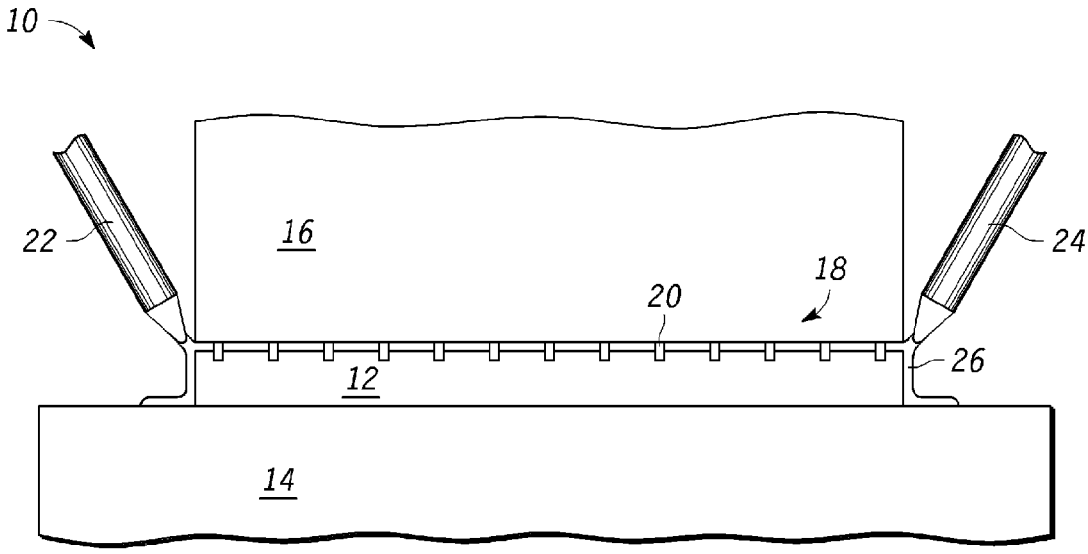
FIG. 2 is a pictorial of the polishing pad and the polishing pad apparatus at a stage in processing subsequent to that shown in FIG. 1.

Shown in FIG. 2 is pattern 18 being placed into polishing pad 12 by the vibration of vibration generator 16 being coupled to polishing pad 12 through liquid 26 and thereby removing selected portions of polishing pad 12 according to pattern 18.

Figure 3:
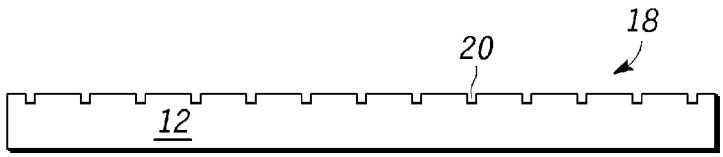
FIG. 3 is a pictorial showing the polishing pad of FIG. 2 with a completed pattern.

Shown in FIG. 3 is polishing pad 12 after completion of forming pattern 18 in polishing pad 12. Grooves may be about a third of the thickness of polishing pad 12 or less. More than a third generally adversely impacts the character of the polishing pad.

Figure 4:
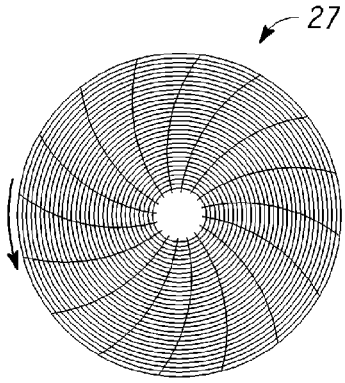
FIG. 4, in accordance with the invention, is a top view of a polishing pad having a desirable pattern useful in polishing a layer.

Shown in FIG. 4 is a polishing pad 27 having a pattern made by the process described for FIGS. 1–3 that has radial spiral grooves in addition to concentric circle grooves. A pattern of concentric circles is the dominant pattern and perhaps the only pattern in commercial use but that is not necessarily the preferred pattern. The process described for FIGS. 1–3 not only can achieve the pattern of polishing pad 27 but can achieve it very quickly, typically less than a minute. The lathe approach with its quality problems and pattern limitations typically takes about 15 minutes.

Figure 5:
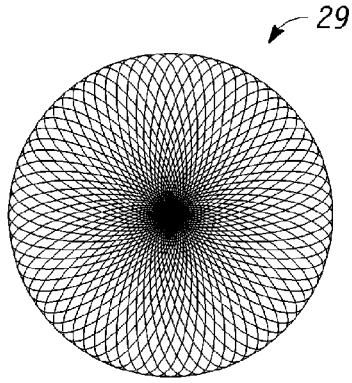
FIG. 5, in accordance with the invention, is a top view of a polishing pad having another desirable pattern useful in polishing a layer.

Shown in FIG. 5 is a polishing pad 29 having a pattern made by the process described for FIGS. 1–3 that has what has been called a floral pattern that does not even have concentric circles. This is another pattern that is also believed to have advantages over the concentric circles pattern.

Figure 6:
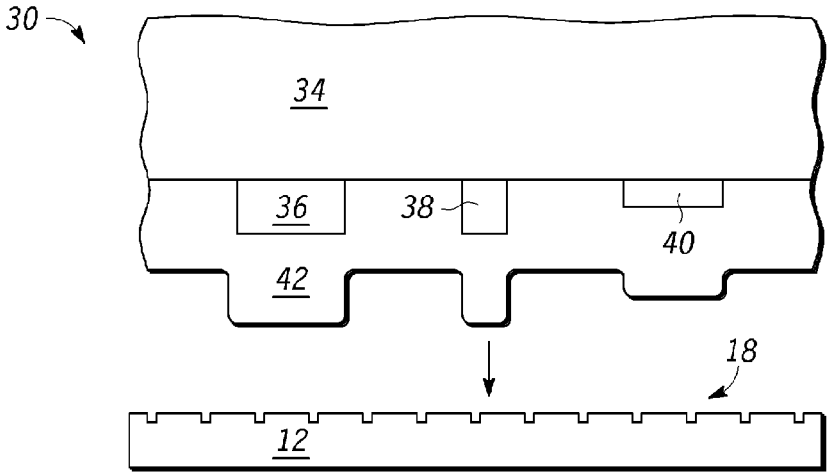
FIG. 6 is a pictorial of a semiconductor device structure and the polishing pad of FIG. 3 at a stage in processing.

Shown in FIG. 6 is a semiconductor device 30 having a substrate 34, features 36, 38, and 40 over substrate 34, and a layer 42 over features 36, 38, and 40. Also shown in FIG. 6 is polishing pad 12 for polishing layer 42 using a CMP step.

Figure 7:
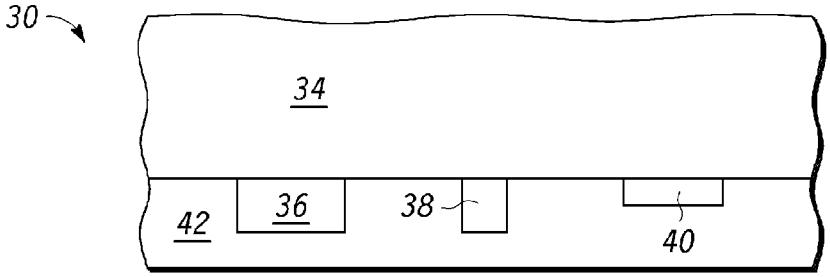
FIG. 7 is a pictorial of the semiconductor device structure of FIG. 6 at a subsequent stage in processing.

Shown in FIG. 7 is semiconductor device 30 after the CMP step. The CMP step planarizes layer 42. Substrate 34 may include a major supporting layer, typically of silicon, in addition to other layers that are one or more of, dielectric layers, gate layers, and interconnect layers. Features 36, 38, and 40 may be gates or other features that have been patterned, typically according to a mask. Layer 42 may be a deposited layer that is either a dielectric or a conductor. Oxide is a common layer to polish.

Figure 8:
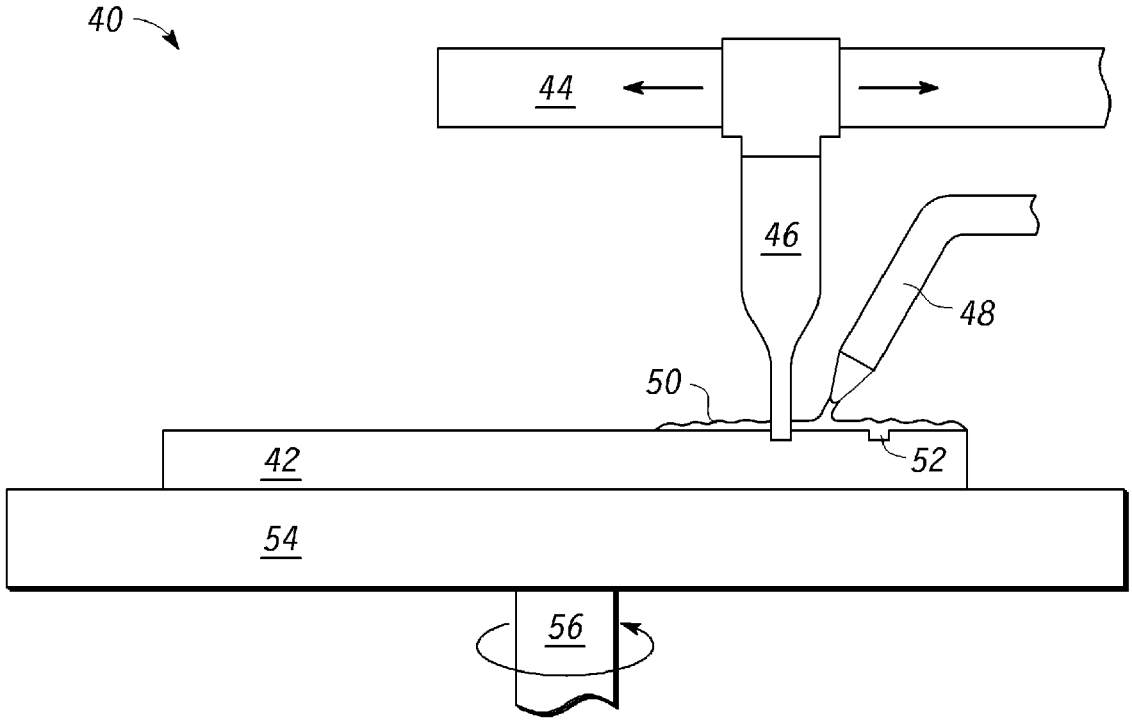
FIG. 8 is a pictorial of a polishing pad and an alternative polishing pad apparatus useful in patterning the polishing pad according to an embodiment of the invention.

Shown in FIG. 8 is an apparatus 40 and a polishing pad 42 to be patterned by apparatus 40. Apparatus 40 comprises position controller 44, a vibration generator 46, a nozzle 48, a liquid 50 for applying over polishing pad 42, a groove 52, a supporting table 54, and a turning drive 56. Apparatus 40 is similar to apparatus 10 of FIGS. 1–2 in that vibration is the source of removing material from polishing pad 42 to form the desired pattern. In this example, the pattern present in vibration generator 16 is far less than the pattern that will ultimately be on polishing pad 52. In fact in this example, vibration generator 46 may be a single point, and supporting table 54 is rotated by turning drive 56 so that a circular groove is formed in polishing pad 52 for a given position of vibration generator 46. Groove 52 is such a groove. Vibration generator 46 and liquid 50 may otherwise be like liquid vibration generator 16 and liquid 26 of FIGS. 1–2. On the other hand, vibration generator 46 may actually cause vibration of a diamond that is used to cut grooves such as groove 52. In such case, vibration generator 46 preferably spins and liquid 52 need not have particles.

Apparatus 10 of FIGS. 1–2 and apparatus 40 of FIG. 8 can be obtained from a company called Sonic Mill in Albuquerque, N. Mex. Examples of their equipment are model AP-1000, AP-10HCV, Rotary CNC Series 10 Bedmill, and Rotary Series 10.

Various other changes and modifications to the embodiments herein chosen for purposes of illustration will readily occur to those skilled in the art. For example, vibration frequencies other than those described, both lower and higher, may be found to be useful. To the extent that such modifications and variations do not depart from the spirit of the invention, they are intended to be included within the scope thereof which is assessed only by a fair interpretation of the following claims.

The invention claimed is:

1. A method comprising:

providing a polishing pad with a major surface;

forming a groove in the major surface of the polishing pad wherein the groove has a predetermined pattern, wherein the step of forming the groove includes:

generating high frequency vibrations;

transferring the high frequency vibrations through a liquid having particles suspended therein that contacts the polishing pad to remove material of the polishing pad in forming the groove.

2. The method of claim 1 wherein the transferring high frequency vibrations includes transferring the high frequency vibrations using a tool component, wherein the tool component contacts the liquid.

3. The method of claim 2 wherein:

the tool component has a surface profile which is generally parallel to the major surface of the pad during the forming the groove, wherein a profile of the bottom surface of the groove generally conforms to the surface profile of the tool component.

4. The method of claim 2 wherein the particles are characterized as abrasive particles.

5. The method of claim 1 wherein the high frequency vibrations are at a frequency of 10,000 hertz or greater.

6. The method of claim 1 wherein the high frequency vibrations are at a frequency of 20,000 hertz or greater.

7. The method of claim 1 wherein the forming a groove in the major surface of the polishing pad includes forming the groove to a depth of at least 0.1 millimeters.

8. The method of claim 1 wherein the applying high frequency vibrations includes generating the high frequency vibrations with a piezoelectric driver.

9. The method of claim 1 wherein the high frequency vibrations are in a direction at least substantially perpendicular to the first major surface of the polishing pad.

10. The method of claim 1 further comprising:

polishing a surface with the polishing pad after the forming the groove.

11. The method of claim 1 further comprising:

polishing a wafer with the polishing pad after the forming the groove.

12. The method of claim 11 further comprising:

forming a semiconductor device from the wafer after the polishing.

13. The method of claim 1 wherein during the forming, the polishing pad is stationary.

14. The method of claim 1 wherein during the forming, the polishing pad is not moving in a rotational direction.

15. The method of claim 1 wherein the material of the polishing pad removed includes polyurethane.

16. A method of polishing of layer, the method comprising:

providing a polishing pad;

generating high frequency vibrations;

transferring the high frequency vibrations to through a liquid having particles suspended therein that contacts the polishing pad to remove material of the polishing pad whereby a grooved polishing pad is formed according to a predetermined pattern; and polishing a layer of a semiconductor wafer with the grooved polishing pad to planarize a surface of the layer.

17. A method of forming a semiconductor device, the method comprising:

providing a polishing pad comprising polyurethane;

generating high frequency vibrations;

transferring the high frequency vibrations to material comprising a liquid having particles suspended therein that contacts the polishing pad to remove material of the polishing pad to form grooves having a depth of at least 0.1 millimeter in a predetermined pattern in the polishing pad;

polishing a work piece, after the step of transferring, using the polishing pad; and forming a semiconductor device from the work piece.

18. A method of claim 17 wherein the work piece is characterized as a wafer including semiconductor material.

* * * * *